US005327705A

United States Patent [19]

DeFigueiredo

[11] Patent Number: 5,327,705

[45] Date of Patent: Jul. 12, 1994

[54] ENVELOPE FLAPPER WITH ADJUSTABLE BLADE

[75] Inventor: Carlos L. DeFigueiredo, Sandy Hook, Conn.

[73] Assignee: Pitney Bowes Inc., Stamford, Conn.

[21] Appl. No.: 914,664

[22] Filed: Jul. 17, 1992

[51] Int. Cl.[5] ..... B65B 43/26

[52] U.S. Cl. ..... 53/569; 53/284.3; 53/381.7

[58] Field of Search ..... 53/284.3, 381.7, 569

[56] References Cited

U.S. PATENT DOCUMENTS

| | | | |
|---|---|---|---|
| 2,668,053 | 2/1954 | Bach | 53/381.7 |
| 2,839,880 | 6/1958 | Boughton | 53/569 |
| 3,568,401 | 3/1971 | Bonsch | 53/284.3 X |
| 3,747,297 | 7/1973 | Hankins | 53/569 X |
| 4,337,609 | 7/1982 | Foster et al. | 53/569 |
| 4,813,209 | 3/1989 | Foster et al. | 53/381.7 |
| 5,081,825 | 1/1992 | Mrozinski | 53/569 |

*Primary Examiner*—John Sipos

*Assistant Examiner*—Linda B. Johnson

*Attorney, Agent, or Firm*—Charles R. Malandra, Jr.; Melvin J. Scolnick

[57] ABSTRACT

In the enclosure inserting apparatus comprising structure for conveying an envelope along a flap unfolding path to an enclosure inserting location, structure for unfolding the flap of the envelope as the envelope is conveyed along the flap unfolding path to the enclosure inserting location, structure for holding the flap-unfolded envelope open at the enclosure inserting location, and structure for moving an enclosure along an enclosure feed path to the held-open envelope and inserting the enclosure into the held-open envelope, wherein the flap unfolding structure comprises structure for engaging the flap of an envelope moved therepast, and the flap unfolding path includes a gap having a width determined by a distance between the envelope conveying structure and the engaging structure, the improvement comprises a flapper blade adjustably mounted to the engaging structure for adjusting the width of the gap.

4 Claims, 5 Drawing Sheets 12
18
12
192
69
152
72
30
68
132
12a
48
175
154
65
16
184
129
67
181
64
180
140
190
49
66
144
146
138
142
43
20
80
82
32
52
54
57
45
56
58
51
47
59
50
46
42
22

14
37
10
66
68
69
192
64
132
131
66
46
38
46
80
170
174
59
172

ENVELOPE FLAPPER WITH ADJUSTABLE BLADE

BACKGROUND OF THE INVENTION

The invention disclosed herein relates to apparatus for inserting documents or enclosures into envelopes, and more particularly to such apparatus which unfolds the envelope flap and feeds the enclosure or enclosures into the "flapped" envelope.

The mailing process involves a number of operations including feeding, assembly and insertion of mail items into an envelope, moistening the envelope flap, sealing the envelope, weighing the envelope, applying postage, etc. Automation of such operations typically includes moving an envelope into and through a station to complete the insertion operation. With respect to the document feeding operations, see, for example, U.S. Pat. Nos. 4,169,341 (Roether et al.), 4,570,923 (Hooper et al.), 4,619,101 (Havey, Jr., et al.), and 4,775,140 (Foster). The disclosures of those patents, which are assigned to the assignee of the present application, are hereby incorporated by reference. Frequently, rollers and belt conveyors are used to move the envelope within a station while the particular mailing operation is carried out.

As the throughput of modern mailing apparatus increases, envelope jamming has occurred more frequently requiring more frequent operator intervention and longer overall machine down time. In addition to the rate that the envelopes are handled, the size, design and weight of the envelopes have an effect on the jam frequency.

Typically, the inserting operation includes an envelope feeder and an envelope "flapper" which unfolds or "flaps" envelope flaps open so that documents may be inserted into the "flapped" envelope at a queuing station. such is the case with U.S. Pat. No. 4,775,140 noted above, which discloses a pivoting frame assembly to provide jam-clearing access to the envelope feed path through the envelope flapper. U.S. Pat. No. 5,081,825 (Mrozinski), assigned to the assignee of the present invention, also discloses a flapping and inserting apparatus which comprises jam-clearing access to the enclosure feed path and the upstream end of the queuing station.

Typically, the inserting apparatus includes a flapper that is suitable for flapping a limited variety of envelope types, or styles, appropriate for the particular use of the inserting apparatus. Problems generally occur because the gap between the flapper and the means for feeding the envelope past the flapper is fixed with little tolerance for handling a variety of envelopes. If the gap is too large for a particular type of envelope, it will pass by the flapper without having the flap opened. If the gap is too narrow, the flap of the envelope may jam or become crimped by the flapper.

Although it is known to adjust the gap between the flapper and the means for feeding the envelope, such an adjustment typically requires a service technician and includes a repositioning of the entire flapper. Furthermore, this becomes a more difficult and sensitive adjustment on inserting apparatus expected to handle envelopes of all sizes, designs and weights. For flappers extending the length of the envelope flap, adjustments in the gap are more sensitive to tolerance across the length of the flapper because problems such as jamming can occur anywhere along the entire length of the flapper.

As a result, adjustments of the flapper position to correct the size of the gap can be repetitive and time consuming.

SUMMARY OF THE INVENTION

In accordance with the present invention, it has been found that an adjustable flapper blade can be added to an envelope flapper device for adjusting the gab between the flapper device and an envelope feeding means. The present invention eliminates the need for a more difficult and sensitive adjustment of the entire flapper device. Thus, the present invention reduces the time needed to complete an adjustment to the gap.

The present invention provides an easy flapper gap adjustment that accommodates at least most envelope styles. It has been found that the present invention increases the throughput of such apparatus by reducing the number of jams and unflapped envelopes during the inserting operation in the inserting apparatus.

The present invention is an improvement to inserting apparatus which flap envelopes and inserts documents into the flapped envelopes. In the document inserting apparatus comprising means for conveying an envelope along a flap unfolding path to an enclosure inserting location, means for unfolding the flap of the envelope as the envelope is conveyed along the flap unfolding path to the enclosure inserting location, means for holding the flap-unfolded envelope open at the enclosure inserting location, and means for moving an enclosure along an enclosure feed path to the held-open envelope and inserting the enclosure into the held-open envelope, wherein the flap unfolding means comprises means for engaging the flap of an envelope moved therepast, and the flap unfolding path includes a gap having a width determined by a distance between the envelope conveying means and the engaging means, the improvement comprises a flapper blade adjustably mounted to the engaging means for adjusting the width of the gap.

The flap engaging means comprises a plurality of fingers each having a projection thereon. The flapper blade is adjustably mounted adjacent to at least one of the projections. The fingers are pivotally mounted to a first frame such that the downstream edge of the envelope moving in the flap unfolding path first engages the projections and pivots the fingers. The flapper blade in the pivoted position of the fingers sets the gap and engages the flap of the envelope and unfolds the flap as the conveying means continues movement of the envelope along the flap unfolding path.

The envelope conveying means comprises a first roller rotatably mounted to a second frame and a second roller mounted to the first frame. The first and second rollers form a nip to which the envelope whose flap is to be unfolded is fed.

BRIEF DESCRIPTION OF THE DRAWINGS

The invention is illustrated by way of example and not limitation in the figures of the accompanying drawings in which like references denote the same or corresponding parts, and in which.

DESCRIPTION OF THE PREFERRED EMBODIMENTS

Figure 1:
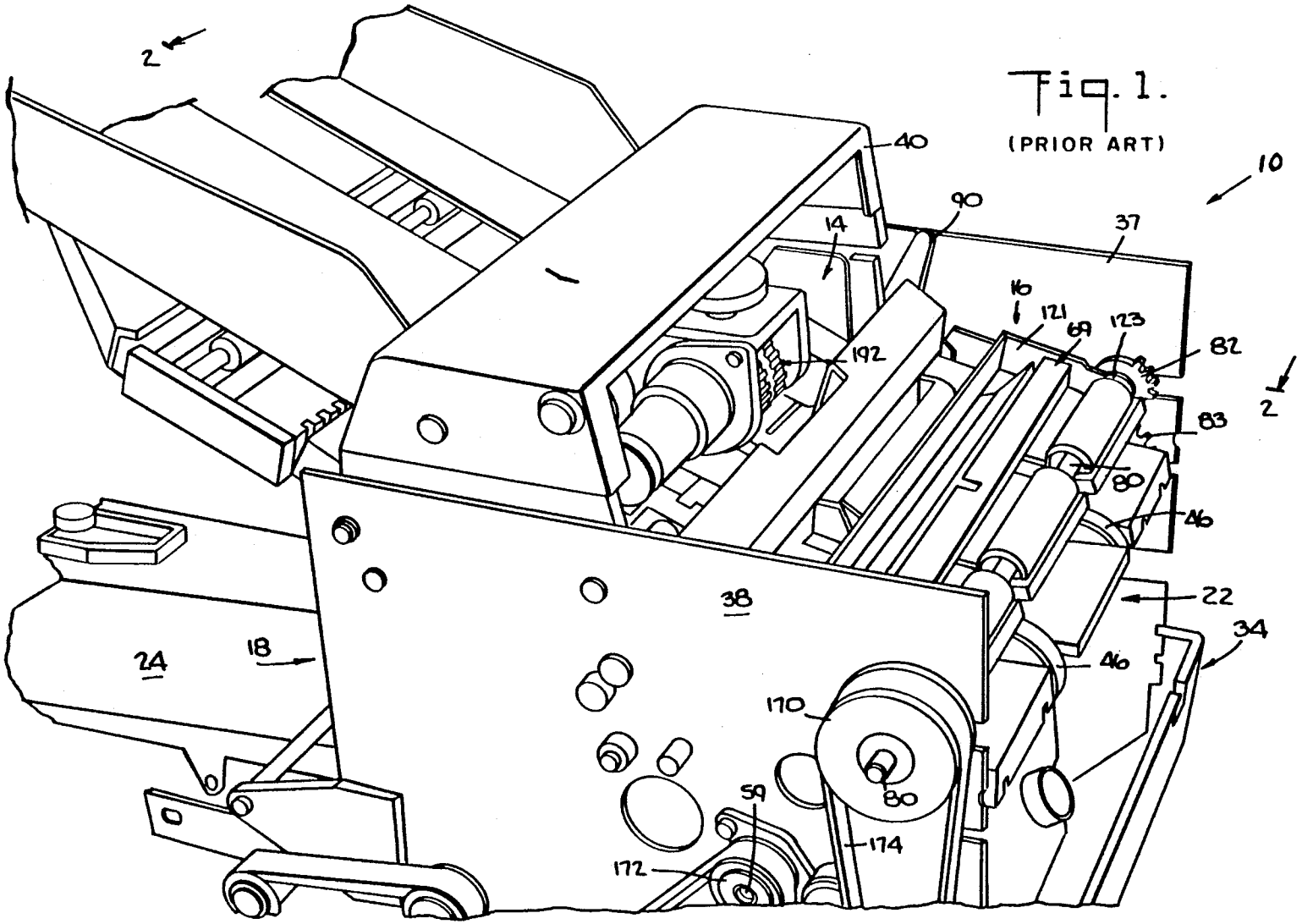
Fig. 1. (PRIOR ART)
FIG. 1 is a perspective view of a prior art apparatus for flapping envelopes and inserting documents into the flapped envelopes.
Figure 2:
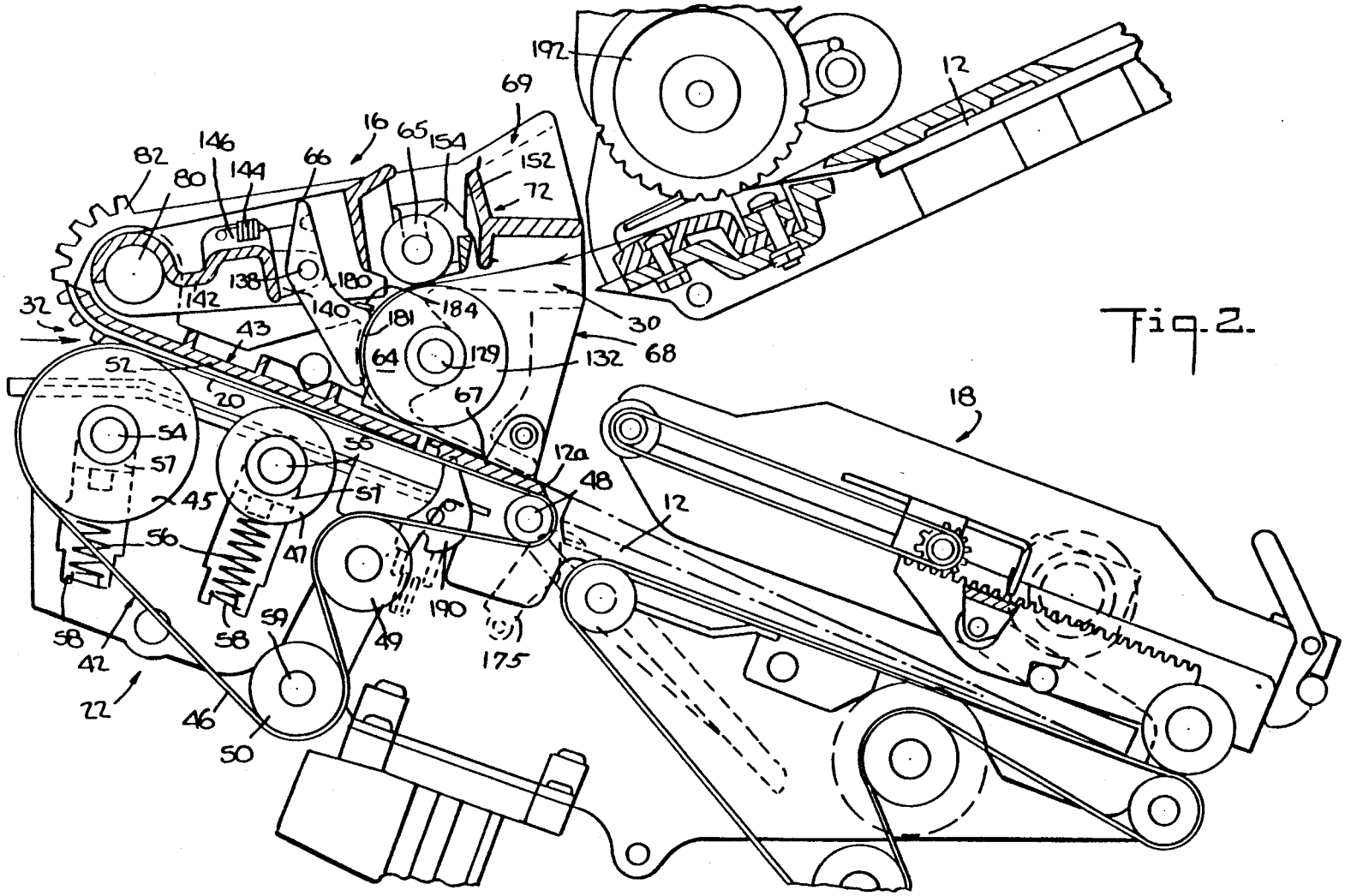
FIG. 2 is a sectional view of the apparatus of FIG. 1 taken along line 2—2 in FIG. 1, showing a flapper assembly including a flapper blade according to the present invention.

FIG. 1 shows a prior art insertion station of an inserting machine such as described in U.S. Pat. No. 5,081,825, issued to C. Mrozinski on Jun. 21, 1992, and assigned to the assignee of the present invention, which is hereby incorporated by reference. The present invention is an improvement to an envelope unfolding assembly in such an insertion station. FIG. 2 shows the insertion station of FIG. 1 including the improvement of the present invention. The following description of the insertion station is limited to the extent necessary for the understanding of the present invention. A more detailed description of the apparatus shown in FIGS. 1 and 2, including jam clearing access, is provided in U.S. Pat. No. 5,081,825.

Referring to FIGS. 1 and 2, apparatus 10 feeds envelopes 12 (not shown in FIG. 1) seriatim from an envelope feeder 14 into an envelope flap unfolding assembly or envelope flapper 16 which flaps the envelope open and feeds the flapped envelope to a queuing station 18 where the envelope is held open for insertion therein of folded documents 20 (not shown in FIG. 1). The folded documents 20 are fed to apparatus 10 from a document processing apparatus not shown in the drawings, entering apparatus 10 at the right in FIG. 1 and the left in FIG. 2. The folded documents 20 are received in apparatus 10 by an enclosure transporter 22 and fed to the queuing station 18 where they are inserted into the held-open envelope 12. The stuffed envelope is then discharged by the queuing station 18 onto a ramp 24 at the left of the apparatus as seen in FIG. 1 where the stuffed envelopes are collected for further processing.

Envelopes fed from envelope feeder 14 are moved by apparatus 10 through flap unfolding assembly 16 to queuing station 18 along an envelope flap unfolding path 30 (FIG. 2), and documents received by apparatus 10 are moved by document transporter 22 to queuing station 18 along a enclosure feed path 32. The present invention is concerned with adjusting the gap in flap unfolding path 30 to reduce or eliminate jams and unflapped envelopes during the feeding of the envelopes to queuing station 18.

Referring to FIG. 1, apparatus 10 includes a base frame 34 comprised of spaced frame sides 37 and 38 from which flap unfolding assembly 16, queuing station 18 and enclosure transporter 22 are supported. Envelope feeder 14 is supported from an upper frame 40 which in turn is supported by frame sides 37, 38. Referring to FIG. 2, enclosure transporter 22 comprises a first or lower assembly or portion 42 and a second or upper portion 43. Lower assembly 42 includes a pair of endless belts 46 (shown in FIG. 1; only one belt 46 is shown in FIG. 2), driven pulley 45 and pressure and idler pulleys 47-50. Upper portion 43 comprises a smooth stationary lower surface 52 disposed opposite endless belts 46. The shafts 54, 55 to which are mounted pulleys 45 and 47, respectively, are resiliently mounted to frame sides 37, 38 to urge belts 46 against lower surface 52 to engage enclosures therebetween. As shown schematically in FIG. 2, ends of springs 56 engage bearings 57 mounted to shafts 54, 55 and spring retainer seats 58 in base frame 34 to urge shafts 54 and 55 upwardly towards lower surface 52, and thereby resiliently urge belts 46 against lower surface 52. Shaft 59 on which pulley 50 is mounted, is driven clockwise (FIG. 2) to drive belts 46 clockwise and move enclosures engaged between belts 46 and lower surface 52 along enclosure feed path 32 to queuing station 18.

Flap unfolding assembly 16 comprises, in addition to the upper portion 43 of enclosure transporter 22, all of the flap unfolding components including opposed rollers 64 and 65, fingers 66 and a flap holding portion 67. The flap unfolding path 30 in flap unfolding assembly 16 passes through the nip of first and second rollers 64 and 65, around first roller 64, above the downstream end of upper portion 43 of transporter 22, over flap holding portion 67 and to the upstream end of queuing station 18. Portions of flap unfolding assembly 16 are mounted on different frames 68, 69 of flap unfolding assembly 16 which are pivoted together so that flap unfolding assembly 16 may be opened to separate second roller 65 from first roller 64 and expose substantially the entire flap unfolding path 30 in flap unfolding assembly 16. This is described in more detail in U.S. Pat. No. 5,081,825, noted above. First frame 69 may be pivoted away from second frame 68 by simply grasping it and pivoting it from the normal operating position shown in FIG. 2 to a flap unfolding path access position (not shown). Jam-clearing access is provided to the enclosure feed path 32 as well as to the flap unfolding path 30.

Figure 3:
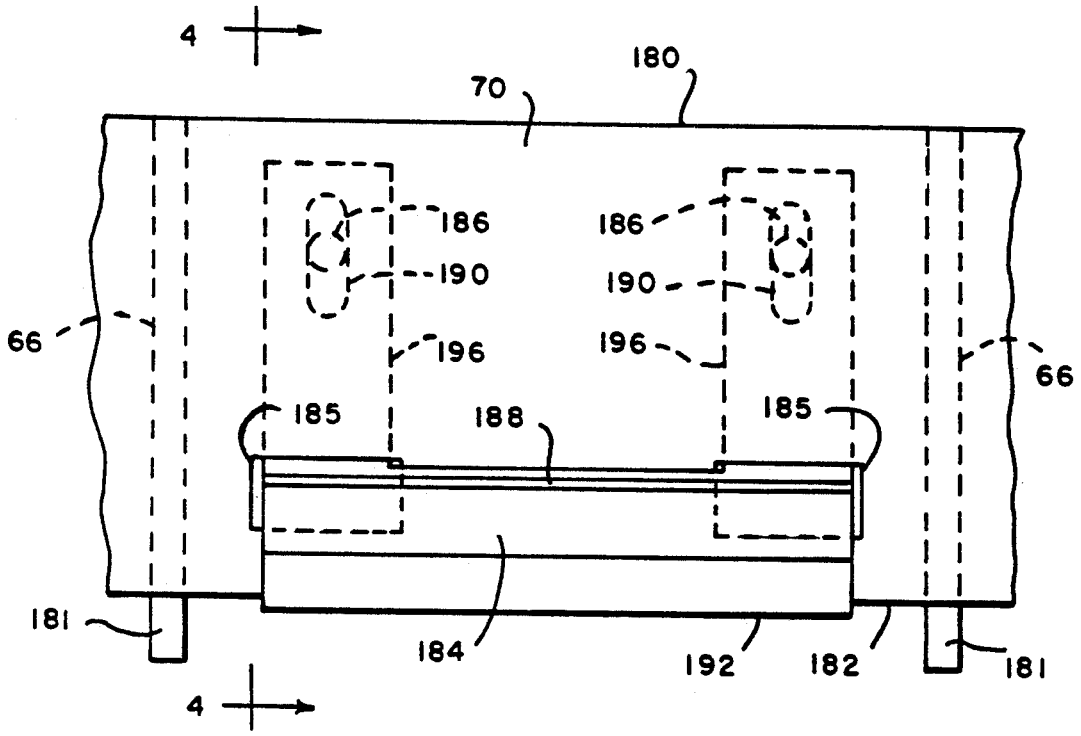
FIG. 3 is a partial plan view of the flapper and flapper blade in the flapper assembly depicted FIG. 2.
Figure 4:
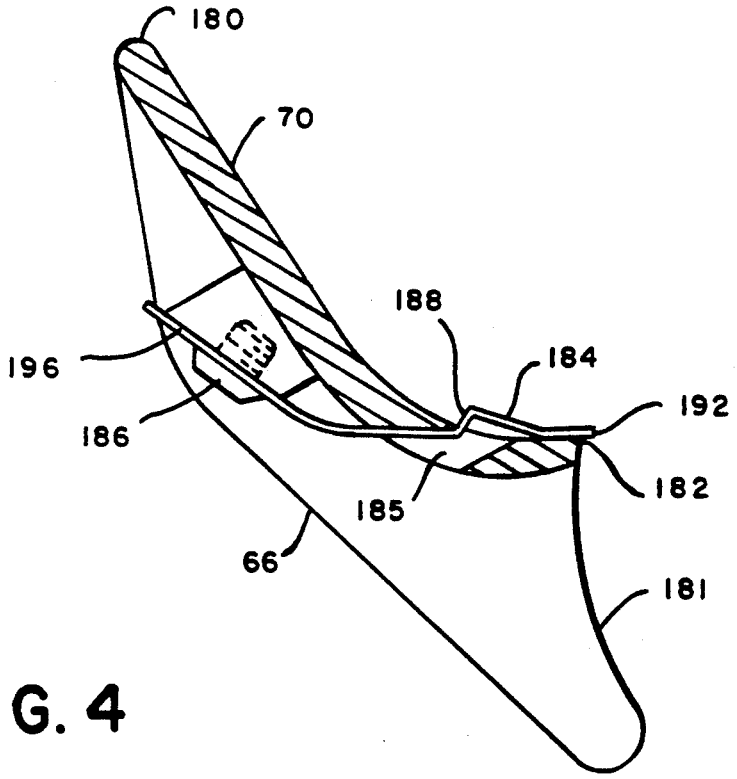
FIG. 4 is a sectional view of the flapper assembly of FIG. 3 taken along the line 4—4.
Figure 5:
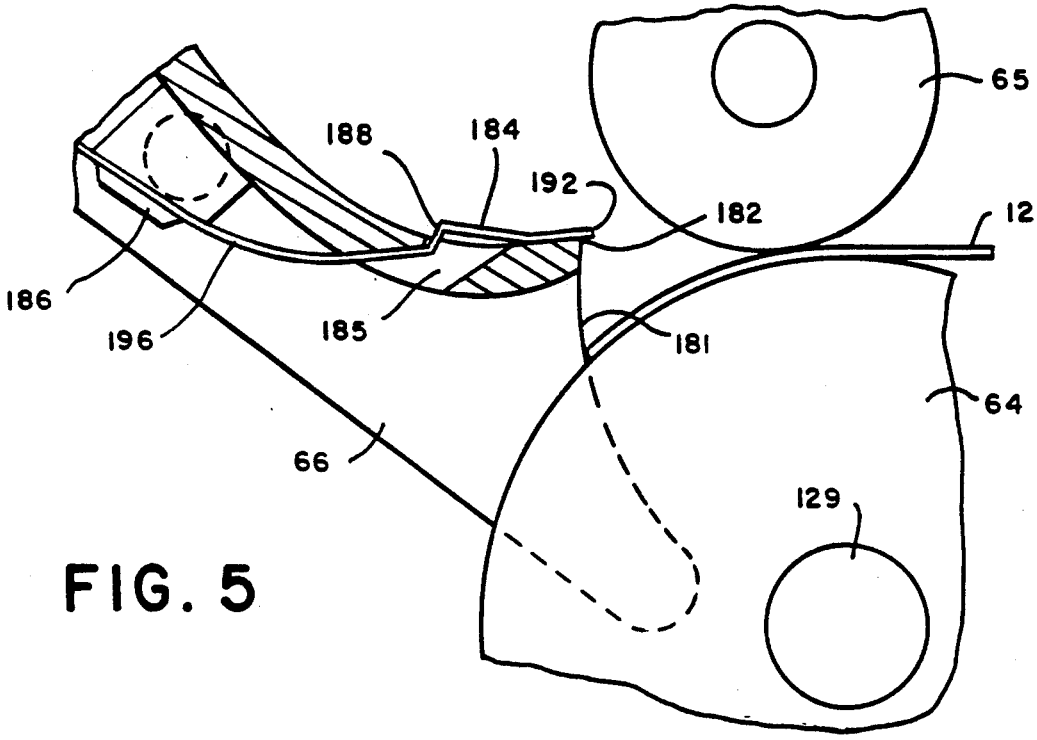
FIG. 5 is an enlarged view of the flapper assembly of FIG. 3 shown before engaging an envelope to be flapped.
Figure 6:
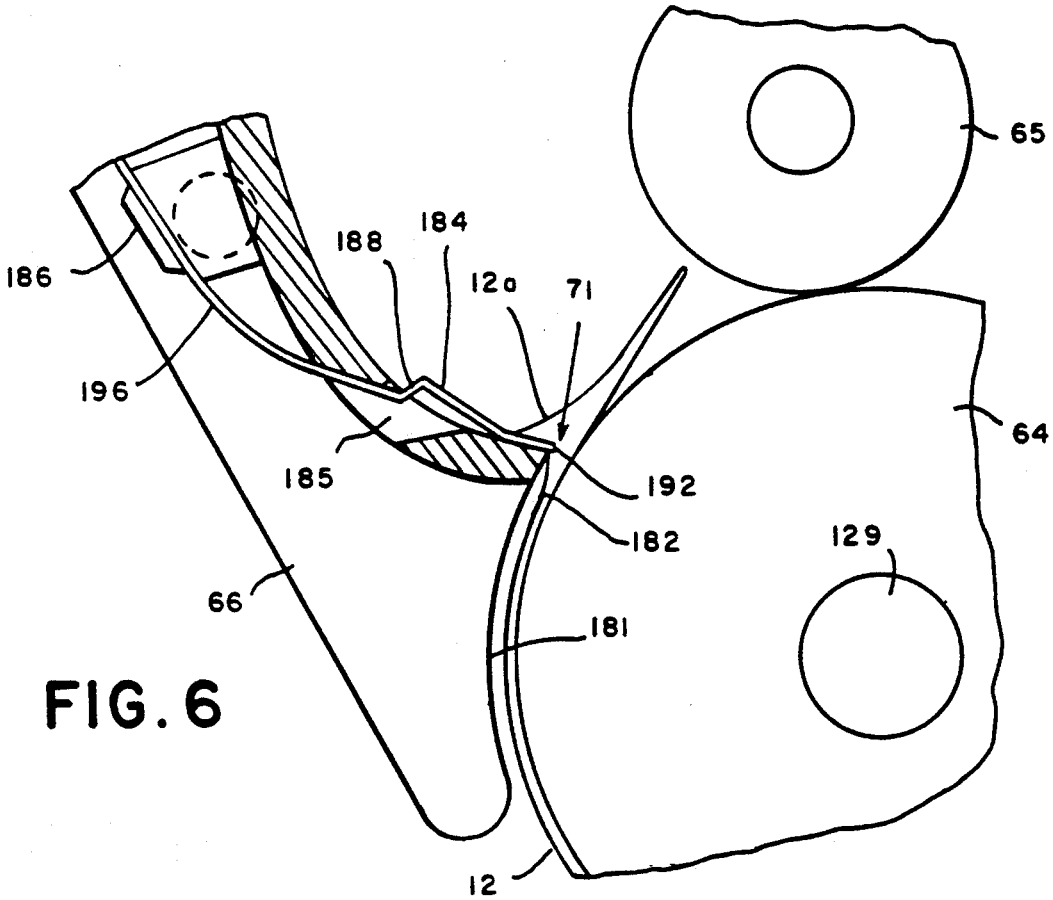
FIG. 6 is a view similar to that of FIG. 5 shown with the flapper assembly flapping an envelope.
Figure 7:
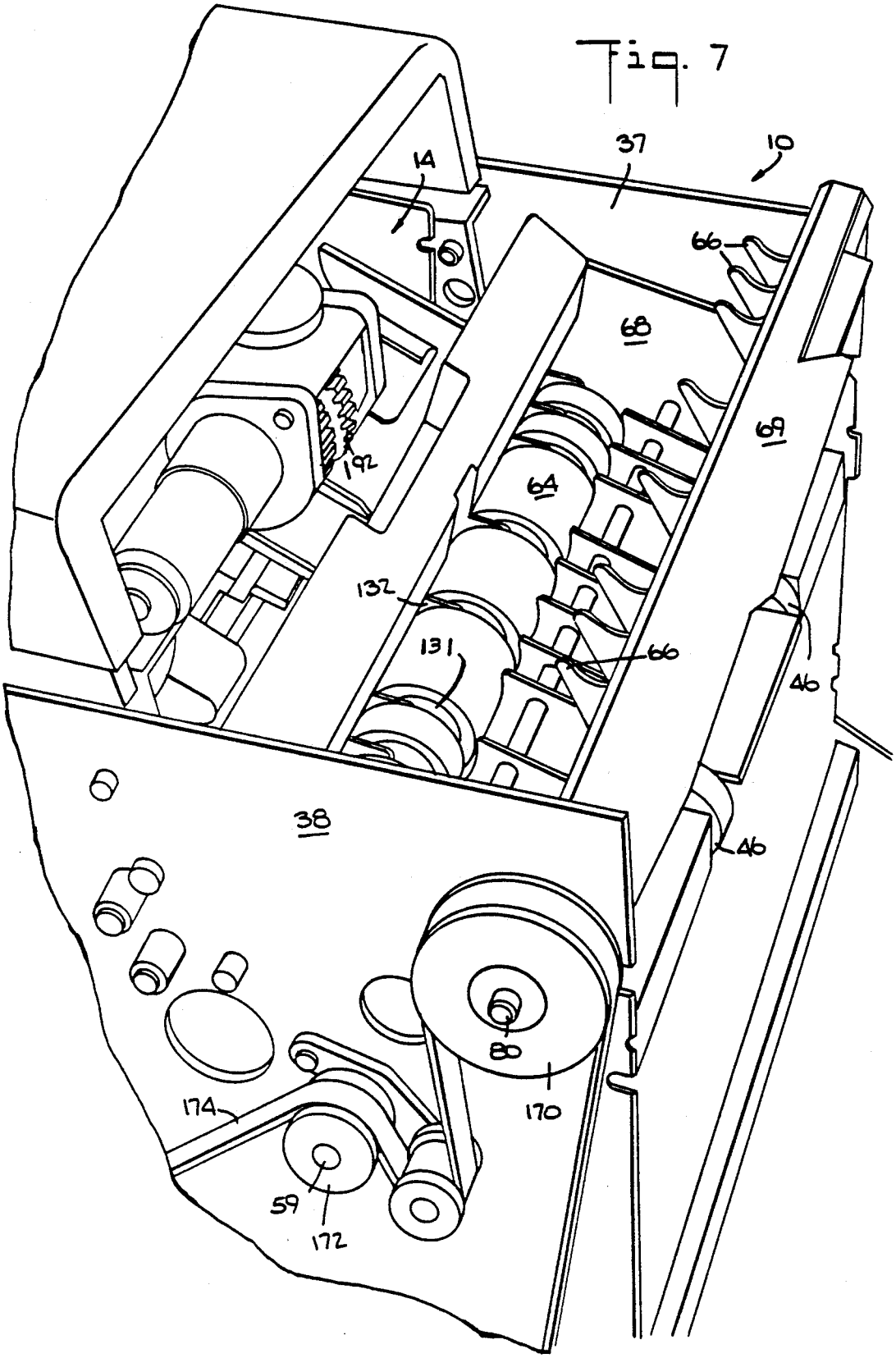
FIG. 7 is a top perspective view similar to that of FIG. 1 but with the envelope unfolding assembly pivoted open.

Referring to FIG. 2, roller 64 of flap unfolding assembly 16 is fixed to shaft 129 which is rotatably supported by frame 68. As shown in FIG. 7, roller 64 has spaced circumferential recesses or grooves 131 therein. Semicircular fingers 132 fixed to frame 68 project into one side of recesses 131 (the upstream side relative to the flap unfolding path 32). As shown in FIGS. 2, 5 and 6, other fingers 66 are disposed in recesses 131 on the downstream side of roller 64. Fingers 66 are connected together at their upper ends by flapper member 70 (which connection is shown in part in FIG. 3) and are fixed to a rod 138 to pivot about the axis of rod 138. Rod 138 is pivotally connected to frame 69. Springs 144 are connected at opposite ends thereof to anchors 146 on sheet-like bracket 142 and to flapper member 70 to urge fingers 66 clockwise into engagement with recesses 131 in roller 64.

Referring to FIGS. 1 and 7, pulleys 170, 172 are fixed to ends of shafts 80 and 59, respectively, on frame side 38 to drive those shafts by means of an endless belt 174 coupled via idler pulleys and pulleys fixed to shafts of queuing station 18 and to a drive pulley connected to a drive motor not shown. Rotation of shaft 59 by pulley 172 drives endless belts 46 of the lower assembly 42 of enclosure transporter 22. Rotation of shaft 80 drives roller 64 as follows. Roller 64 is driven by means of a pair of endless belts coupled by pulleys (not shown) that are fixed to shaft 80 and pulleys (not shown) that are fixed to shaft 129. Thus, a single drive source via drive belt 174 may provide the drive for envelope flap unfolding assembly 16, enclosure transporter 22 and queuing station 18. Moreover, by driving shaft 80 and by driving roller 64 via belts carried within flap unfolding assembly 16, it is possible to pivot the entire flap unfolding assembly 16. This arrangement also makes it possible to pivot frame 69 relative to frame 68 since shaft 80, belts 176 and roller 64 are all mounted to frame 68.

In accordance with the present invention, the unfolding of an envelope flap is initiated by a flapper blade 184 which can be adjusted to facilitate a more reliable flapping of envelopes than is experienced with the conventional use of only a flapper with a fixed projection. Referring to FIGS. 3–6, the flapper blade 184 is adjustably mounted to at least a center section of flapper member 70 for controlling the gap 71 between projection 182 of finger 66 and roller 64 when finger 66 has been pivoted by envelope 12 being conveyed past finger 66. Flapper blade 184 fits in the center of flapper member 70 and includes a pair of legs 196 which extend through two apertures 185 in flapper member 70. Each leg 196 has a slot 190 for adjustable mounting of flapper blade 184. There may be a stiffening member 72 suitably mounted to flapper member 70, for example by screws (not shown), and extending approximately the length of flapper member 70 to stiffen flapper member 70 during the flapping of envelope 12. Flapper blade 184 is mounted to flapper member 70 by means of screws 186 which are secured to stiffening member 72 through slotted leg 196. Flapper blade 184 may be mounted directly to flapper member 70 in a similar manner if stiffening member 72 is not used.

Gap 71 between flapper blade edge 189 and roller 64 is adjusted and set by loosening screws 186 and sliding flapper blade 184 until a gap suitable for the particular style of envelope being fed is obtained. Thus, the gap is set to eliminate, or at least significantly reduce the number of envelope jams and unflapped envelopes associated with the feeding of envelopes of various styles, size and weight.

In the preferred embodiment of the present invention, blade 184 is a stainless steel spring which is U-shaped for rigid mounting on flapper member 70. Flapper blade 184 also includes a step 188 to allow envelope flap **12*a* to ramp above opening 185, thereby avoiding jams caused by flaps 12*a* striking opening 185. Tightening screws 186 causes blade 184 to flex flush against flapper member 70 at projection 182. It will be understood by those skilled in the art, that blades of other material can be used so long as the portion of the blade extending beyond flapper member 70 remains rigidly flat against the projected portion 182 of flapper member 70**.

FIGS. 5 and 6 illustrate a sequence for flapping an envelope. Each finger 66 includes upper and lower oppositely curved edges 180, 181 which form projection 182 therebetween. The lower portion of lower edge 181 rests in circumferential recess 131 with projection 182 disposed beyond the circumference of roller 64 as depicted in FIG. 5. Envelopes 12 are fed to flap unfolding assembly 16 with the flap side up and the flap at the upstream edge of the envelope, i.e., the edge of an envelope 12 opposite the flap edge enters the nip of rollers 64 and 65 first as shown in FIG. 5.

Rotation of roller 64 winds the envelope around roller 64 until the downstream edge of the envelope contacts the projections 181 of fingers 66 and pivots fingers 66 clockwise as envelope 12 rides along the lower edges 181 of fingers 66. Continued rotation of roller 64 causes the downstream edge of envelope 12 to pass over flap holding portion 67 and enter queuing station 18. Stationary fingers 132 (not shown in FIGS. 5 and 6) projecting into recesses 131 prevent the downstream edge of envelope 12 from winding completely around roller 64. At the same time, envelope flap **12*a* hits flapper blade 184 and rides over projection 182 onto upper finger edges 180, as depicted in FIG. 6. Thus, the flapping or opening of the envelope flap 12*a* is initiated. As roller 64 is rotated still further, flap 12*a* rides further on upper finger edges 180 until the flap 12*a* is fully opened (not shown in the sequence of FIGS. 5 and 6), after which the flap 12*a* of envelope 12 continues to be advanced around roller 64 while the downstream edge of envelope 12 enters queuing station 18. Finally, movement of envelope 12 is stopped with the flap 12*a* resting on the upper surface of flap holding portion 67 mounted to frame 68 (shown in phantom in FIG. 2). At that time, a pair of spaced claws 175 (only one of which is shown) is pivoted into the opening of flapped envelope 12 to open the envelope sufficiently to receive enclosures advanced along enclosure feed path 32 by enclosure transporter 22. After the enclosures have been inserted into the held-open envelope 12, the envelope is discharged from apparatus 10 onto ramp 24 by the queuing station 18**.

Timing for feeding envelopes 12 into flap unfolding assembly 16, feeding enclosures into enclosure transporter 22, pivoting claw 188 and discharging a stuffed envelope 12 from queuing station 18 is derived from the following sensors: a sensor (not shown) in the envelope feeder 14 which senses passage therefrom of the downstream edge of an envelope; a sensor (not shown) in queuing station 18 senses receipt of an envelope to be stuffed; a sensor or sensors (not shown) sense opening of an envelope by claws 188 and positioning of an opened flap on flap holding portion 67 in the flap unfolding path 30; and a sensor 190 in enclosure transporter senses passage therepast of enclosures being inserted into an envelope 12. Those sensors are coupled to a system controller (not shown) which controls the drive for rollers 192 in envelope feeder 14, feeding of enclosures to enclosure transporter 22, pivoting of claws 188 and discharge of stuffed envelopes by queuing station 18. Roller 65 in flap unfolding assembly 16 and belts 46 in enclosure transporter 22 are driven continuously. Thus, control is achieved by properly timing feeding of envelopes, the dwell time of a held-open envelope in queuing station 18, feeding of enclosures into enclosure transporter 22, and discharge of stuffed envelopes, as monitored by the sensor described above. A system controller and sensors to achieve the foregoing functions and timing are within the skill of those in the relevant art.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. In an apparatus for inserting enclosures into envelopes comprising means for conveying an envelope along a flap unfolding path to an enclosure inserting location, means for unfolding the flap of the envelope as the envelope is conveyed along the flap unfolding path to the enclosure inserting location, means for holding the flap-unfolded envelope open at the enclosure inserting location, and means for moving an enclosure along an enclosure feed path to the held-open envelope and inserting the enclosure into the held-open envelope, wherein the flap unfolding means comprises a plurality of fingers each having a projection thereon for engaging the flap of an envelope moved therepast, and the flap unfolding path includes a gap having a width determined by the distance between the envelope conveying means and the projections of the fingers, an improvement comprising:

a flapper blade adjustably mounted to at least one of the finger projections for positioning said flapper blade to extend a certain distance beyond the projection to adjust the gap width to accommodate different type envelopes.

2. The improvement of claim 1 wherein said fingers are pivotally mounted to a first frame such that the downstream edge of the envelope moving in the flap unfolding path first engages said projections and pivots said fingers, said flapper blade in the pivoted position of said fingers setting the gap and engaging the flap of the envelope and unfolding it as the conveying means continues movement of the envelope along the flap unfolding path.

3. The improvement of claim 2 wherein the envelope conveying means comprises a first roller rotatably mounted to a second frame and a second roller mounted to said first frame, said first and second rollers forming a nip to which the envelope whose flap is to be unfolded is fed.

4. The improvement of claim 1 wherein said flapper blade comprises a U-shaped stainless steel spring having slotted members for adjustable mounting to said engaging means.

* * * * *